United States Patent [19]

Person

[11] Patent Number: 4,478,021

[45] Date of Patent: Oct. 23, 1984

[54] CONSTRUCTION MATERIAL, A MODULAR, PRE-INSULATED AND FURRED STRUCTURAL MASONRY BUILDING BLOCK

[76] Inventor: Gary J. Person, 105 Arlene Dr., North Versailles, Pa. 15137

[21] Appl. No.: 428,958

[22] Filed: Sep. 30, 1982

[51] Int. Cl.[3] ..... E04B 2/00

[52] U.S. Cl. ..... 52/375; 52/309.7; 52/612

[58] Field of Search ..... 52/309.12, 309.2, 309.7, 52/309.8, 367, 368, 370, 375, 376

[56] References Cited

U.S. PATENT DOCUMENTS

| | | | |
|---|---|---|---|
| 1,310,220 | 7/1919 | Taylor | 52/375 |
| 1,486,935 | 3/1924 | Swanson | 52/375 |
| 2,049,907 | 8/1936 | Hess | 52/375 |
| 3,632,725 | 1/1972 | Jones | 52/309.12 |

FOREIGN PATENT DOCUMENTS

| | | | |
|---|---|---|---|
| 2525539 | 12/1976 | Fed. Rep. of Germany | 52/612 |
| 2424 | 9/1861 | United Kingdom | 52/375 |

*Primary Examiner*—Henry E. Raduazo

[57] ABSTRACT

A modular, pre-insulated and furred structural masonry building block comprised of a basic structural masonry element of modular dimension which incorporates into its construction by entrapment through a series of interlocking dovetail-shaped grooves. First: A furring element to allow the attachment of fixtures and finishes directly to the finished wall by the simplest means, nails or screws and the like, and second: A insulating element with a vapor barrier attached thereto which provides 100 percent full face area coverage including the mortar joints between block, and further incorporates into its design an excess mortar pocket around the perimeter between the elements which will allow the edges of the individual insulating elements to butt squarely together forming a continuous thermal barrier.

5 Claims, 6 Drawing Figures

CONSTRUCTION MATERIAL, A MODULAR, PRE-INSULATED AND FURRED STRUCTURAL MASONRY BUILDING BLOCK

BACKGROUND OF THE INVENTION

1. Field of the Invention

In recent years, two fundamental economic revelations have occurred. We have seen the end of cheap labor as a substitution for material costs; and just now, we are witnessing the demise of cheap energy as the primary means of overcoming a lack of efficiency in many fields. Thus, in an effort to simultaneously reduce building energy requirements and construction labor cost, this invention relates to an improved construction material of modular design which may be used by large contractors or the common man alike to simultaneously produce a highly insulated, prefurred, structurally sound masonry building wall without heavy equipment or specialized hardware and thereby realize a substantial utility operating cost, time and labor savings.

2. Description of the Prior Art

The prior art in this field with respect to insulating a masonry building block or a wall made thereof consists primarily of individual insulated inserts to bulk fill materials to be positioned within the voids or hollow cores of each block. Generally, this is done at an additional labor cost as each course of block is laid up. The prior art thereby allows a considerable breach of the thermal barrier since each block generally will have at least three masonry bridges which join the interior and exterior facing surfaces. A wall insulated in this manner will have a low thermal efficiency as energy may readily pass through the wall between the insulated cores via the aforementioned masonry bridges. Within the scope of the prior art it therefore becomes necessary, if one is to achieve the maximum thermal efficiency, to apply insulating material to the surface of the finished wall as a completely separate time, labor and material consuming operation. Very often, in an effort to minimize the additional cost of applying a full coverage insulation system the material will be attached by means of adhesives which may deteriorate and fail with age or repeated cycles of temperature and humidity.

In the prior art with respect to the furring of a masonry wall, that is the attachment, usually of wooden strips or the like to provide a suitable base for the installation of wall finishes, fixtures or insulation by some means other than adhesives to insure the permanents of the work, this requiring either that a number of holes first be drilled into the masonry structure at approximately sixteen inch centers for the insertion of specialized hardware, such as expansion or toggle bolts and the like or the use of powder actuated fastening systems, which can be damaging to hollow core masonry walls and require highly specialized guns to fire the hardened anchors through the furring members and into the mortar joints. Moreover, the attachment of furring strips to a masonry wall in the prior art is also a costly process both in labor and materials.

In view of the preceding it then becomes obvious that improvements can be made in the prior art.

A SUMMARY OF THE INVENTION

The modular, pre-insulated and furred structural masonry building block in accordance with the invention overcomes many of the aforementioned disadvantages of the prior art. The invention contemplates providing a rectangular-shaped structural masonry element comprised of facing and reinforcing panels arranged perpendicular to each other to form a building block having a series of hollow interior core areas, primarily enclosed on four sides by the working and reinforcing panels, yet open at either end to allow the placement of reinforcing rods, concrete, electrical conduits and the like from course to course as may be desired.

It is further contemplated that at least one of the facing panels shall have formed into its surface a series of dovetail-shaped grooves to facilitate the permanent attachment thereto of a preformed insulating element. Said element likewise having an identical but opposing set of dovetail-shaped grooves such that the two elements shall be interlocked into a single unit by entrapment. This means of attachment providing a bond superior to that of the adhesives used extensively in the prior art. The opposite face of said insulating element shall have a suitable vapor barrier permanently affixed thereto. The invention also contemplates a furring element formed of a material such as wood or the like, having the cross sectional appearance of an hourglass to be permanently entrapped between the adjoining surfaces of the masonry and insulating elements. Finally: The invention contemplates an excess mortar pocket positioned around the perimeter of each block in the area of the junction between the insulating and masonry elements. The pocket being formed when two blocks are positioned together during the construction of a wall, by a combination of grooves and offsets designed into each of the elements. The pocket then created provides a void space into which excess mortar may escape so as to allow a flush, tight alignment of the insulating elements, promoting a uniform thermal barrier.

The incorporation of the furring and insulating elements directly into the structure of each individual block will eliminate the need for two separate time, labor and material consuming operations in the construction of a wall of equivalent thermal value and strength, simultaneously providing a suitable permanent base for the attachment of fixtures and wall finishes by very simple means such as nails, screws and the like. The units described herein would be compatible in weight and dimension to common building block and thereby easily assembled by an individual skilled in the mason's trade without the necessity of specialized tools, fixtures, mortars or hardware.

Other objects, advantages and features of this invention will become apparent to one skilled in the art upon consideration of the written specification, appended claims and attached drawings.

BRIEF DESCRIPTION OF THE DRAWINGS

Drawing 1.

Drawing 1.

Drawing 2.

Drawing 2.

Drawing 2.

Drawing 3.

DESCRIPTION OF THE PREFERRED EMBODIMENT

Figure 1:
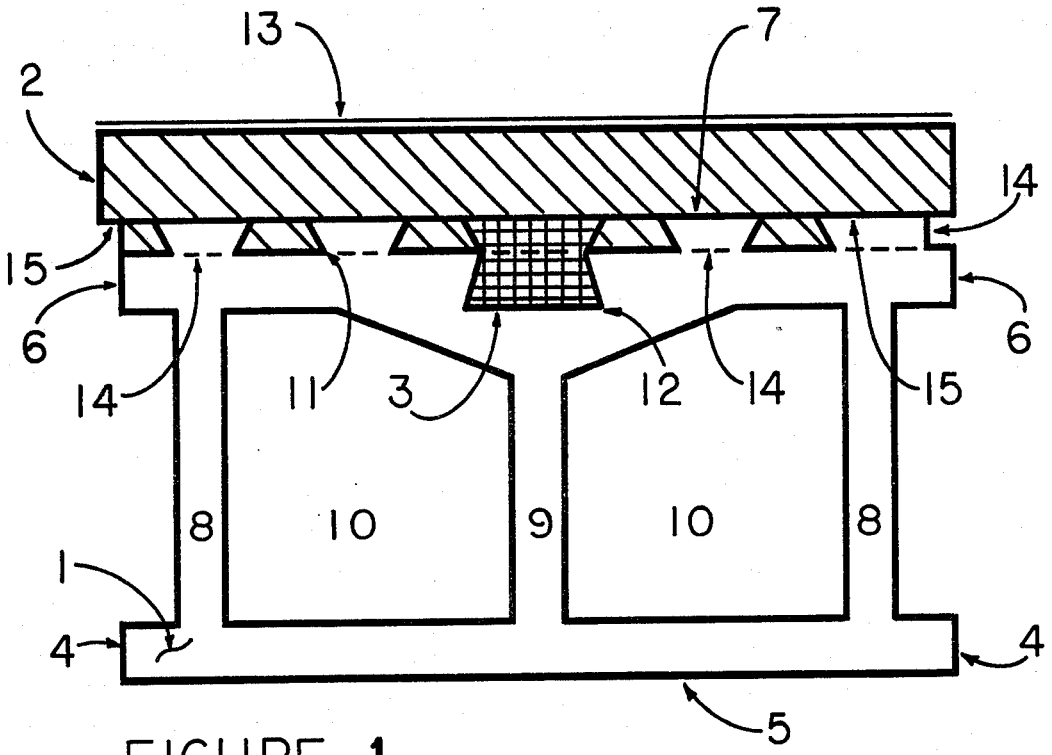
FIG. 1: a plan view of the building block as it would be designed for a straight run of the wall.

FIG. 1 illustrates a modular, pre-insulated and furred structural masonry building block comprised of a structural masonry element (1), An insulating element (2), and a furring element (3). Said masonry element consisting of two parallel facing panels, one being the building interior facing panel (6) and the other being the building exterior facing panel (4), both panels of substantially the same face area, but not necessarily of uniform thickness, design or finish. Said panels would be joined together near the ends and at least one intermediate point by three or more reinforcing panels (8 and 9) arranged perpendicular to the facing panels (4 and 6), having their unattached edges primarily flush with the upper and lower edges of the facing panels, to form a series of voids (10) totally enclosed on four sides yet open at either end producing a rectangular box-shaped element, including a building interior facing surface (7) and a building exterior facing surface (5). The exterior facing surface (5) of the facing panel (4) may, for aesthetic purposes, be smooth, textured, embossed with designs or simulations of other materials such as brick or stone, or coated with resins or glazes, or combinations thereof as a means of producing the desired finish. The interior facing surface (7) of the second facing panel (6) shall have formed into its surface a series of trapezoidal-shaped grooves (11 and 12) more commonly known as "dovetails", with at least one such groove (12) being of greater dimension than the others to accommodate the furring element (3). The purpose of these grooves is to provide a simple means of bonding the furring element (3) and insulating element (2) by entrapment into the structural masonry element (1) without the use of fasteners or adhesives.

A groove (14), representing one-half of an excess mortor pocket shall be formed into the insulating (2) and masonry (1) elements during the molding process. Said pocket shall extend along the entire length of the two adjoining edges at the interior facing surface (7) where the insulating and masonry elements are flush. All parts of the heretofore described masonry element (1) would be integrally formed and simultaneously cast of ceramics, clays or cement and aggregate mixtures to form a single structurally sound masonry element, the weight and dimensions of which would be compatible with those of commonly available building blocks.

Said furring element (3) shall be formed of wood or such other material which will readily accept common fasteners such as nails, staples or screws and the like. The furring element (3) shall have a length equal to the height of the facing panel (6), that being approximately seven and five-eighths inches (7-$\frac{5}{8}$") and a cross section in the appearance of an hourglass being two trapezoidal shapes attached together at the base of lesser dimension, forming a back to back dovetail which will cause the furring element (3) to become entrapped within the dovetail-shaped grooves (11 and 12) of the masonry element (1) and the insulating element (2).

The furring element at its narrowest point shall be of adequate width to provide a reasonable zone of attachment for interior building fixtures and finishes. One end of the furring element shall have cut into it a rectangular offset which shall act as a continuation of the excess mortar pocket (14) which is formed into the interior facing surface (7) of the masonry element.

Said insulating element (2) shall be of a rigid self supporting material of uniform strength and density. The thickness and actual formulation of this material shall vary depending upon the thermal and fire rating requirements for the service intended. The overall length and width of the insulating element (2) shall be eight inches by sixteen inches (8"×16"), exceeding the dimensions of the interior facing surface (7) of the masonry element (1) by three-eighths of one inch ($\frac{3}{8}$") in each direction, creating an offset (15).

During the manufacturing process, the insulating element (2) shall be aligned with the masonry element (1) in such a way that the additional three-eighths inch portion (15) will extend beyond only two adjoining edges of the interior facing surface (7), these edges being opposite those of the masonry element into which the first half of the excess mortar pocket (14) has been formed. This misalignment will serve to cover the mortar joints between the block when they are assembled into a wall. (See FIGS. 4 and 5.)

Figure 4:
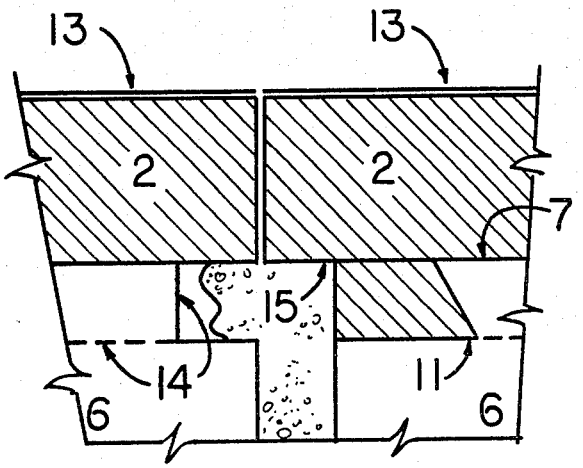
FIG. 4: an enlarged plan view of the mortar joint between two blocks illustrating the relation of the two halves of the excess mortar pocket.
Figure 5:
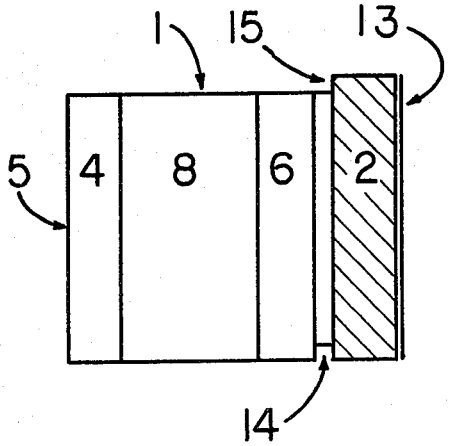
FIG. 5: an elevation of the block shown in FIG. 1 as viewed from the end, to further clarify the relation of the excess mortar pocket to the insulating and masonry elements.

Along the edge where the aforementioned misalignment meets the interior facing surface (7), the misalignment shall be cut back to form an offset (15), the second half of the excess mortar pocket in such a manner that when the blocks are assembled into a wall the two halves of the pocket (14 and 15) will mate as shown on Drawing 2, FIG. 4, to form a void. The purpose of this feature is to provide space into which mortar may escape when blocks are assembled allowing a flush, tight alignment of adjoining insulating elements.

That surface of the insulating element (2) which adjoins the interior facing surface (7) of the masonry element shall have formed into its face a series of trapezoidal-shaped grooves, (11) being of exactly the same dimensions, but opposite hand in position to those of the masonry elements so as to form a interlocking dovetailed matrix with the masonry (1) and furring (3) elements. That surface of the insulating element (2) which faces the building interior shall have a vapor barrier (13) permanently attached thereto.

Figure 6:
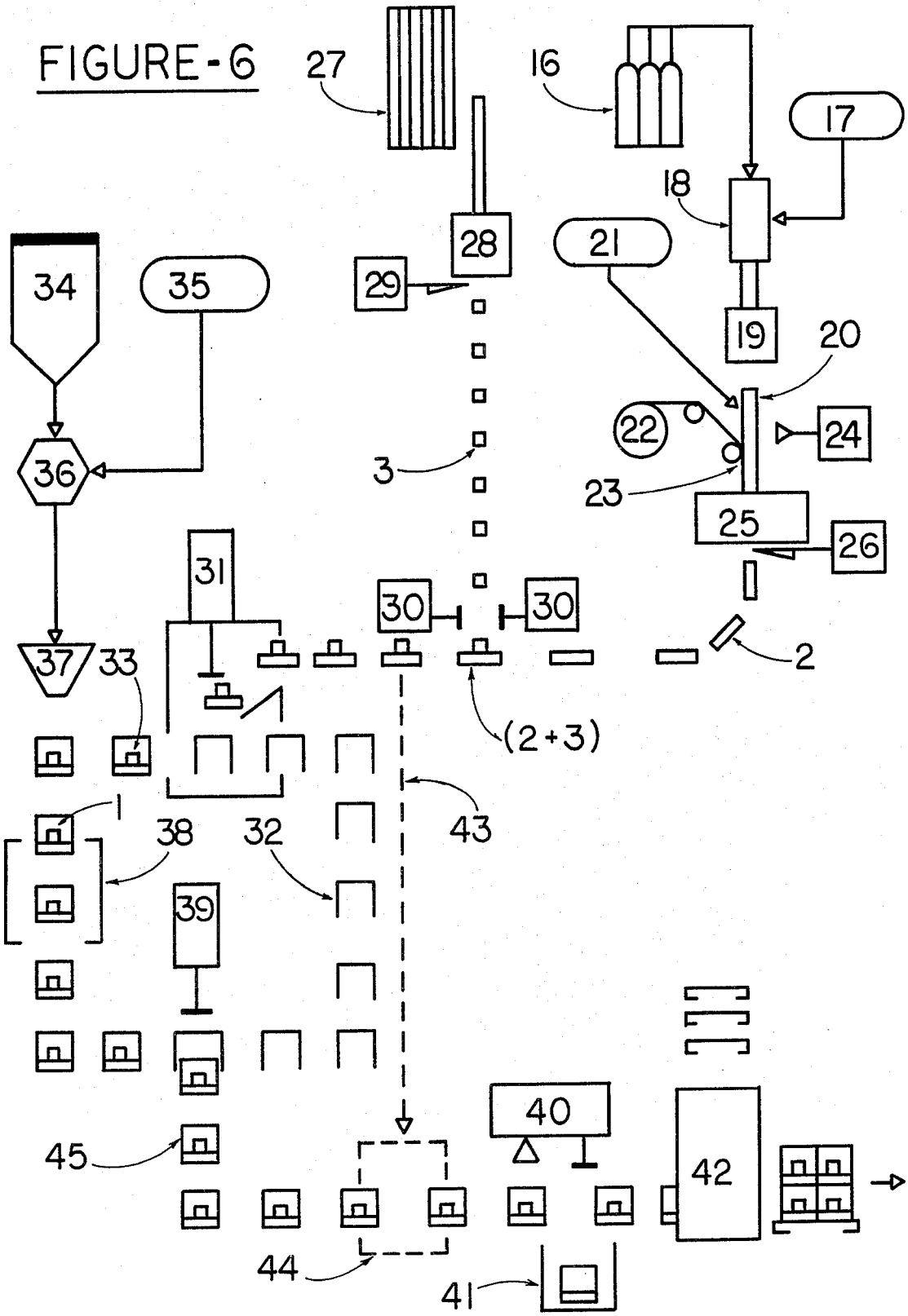
FIG. 6: a diagram of the method of manufacture.

FIG. 6 illustrates a manufacturing sequence. The necessary components (16, 17, etc.) for an insulating element with the physical and thermal properties desired for the intended application shall be formulated (18) and extruded (19) in a continuous component (20) of the required cross sectional design. One surface of said extrusion shall then be prepared (21) and a vapor barrier (22) attached (23) thereto. Said extruded insulating component (20) shall then be imprinted with technical data as necessary (24), trimmed (25), and cut (26) to produce the final pre-shaped insulating element (2). Simultaneously bulk furring material (27) will be fed through a shaping (28) and cutting (29) station to produce the final pre-shaped furring element (3). These two elements shall then be positioned and interlocked (30) together by means of their respective dovetail configuration. The interlocked furring and insulating elements (2+3) shall next be positioned (31) in an empty mold cavity (32) to form the void (33) necessary for production of the masonry element (1). The dry (34) and liquid (35) materials to formulate the desired type of masonry element would be measured, and mixed (36) to the proper consistancy for injection (37) into the mold cavities (33). This will fill the dovetail-shaped grooves (11) previously formed into the insulating and furring elements (2+3) to create opposing dovetail-shaped projections, permanently interlocking all three elements of the modular pre-insulated and furred structural masonry building block together into a single unit (45). The molded units would be cured (38) and the finished blocks (45), ejected (39) for inspection (40). Defective units (41) shall be removed, and the finished product would move to a palletizing assembly (42) for packaging and shipment to distributors. If the service intended is such that the masonry element (1) is to be formulated of clay or ceramics, the curing step (38) shall be modified to include a baking or firing operation and a cooling procedure. The interlocked furring and insulating elements (2+3) will then bypass the positioning step (31) and be routed (43) to a finishing procedure (44) where all three elements shall be assembled into a finished unit (45).

From the foregoing, it will be seen that this invention is one well adapted to attain all of the ends and objects previously set forth, together with other advantages which are obvious and inherent to the apparatus. It will be understood that certain features and subcombinations are of utility, and it is recognized that modifications and variations may readily occur to those skilled in the art.

Figure 2:
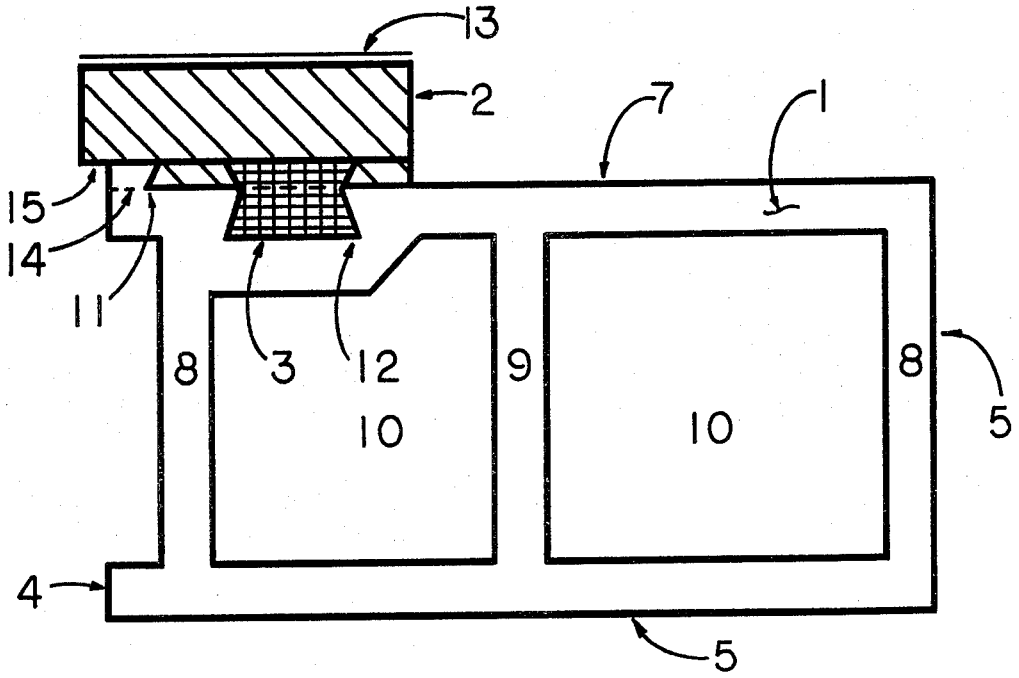
FIG. 2: a plan view of the building block shown in FIG. 1 as it would be modified to facilitate a 90 degree change in the direction of the wall.
Figure 3:
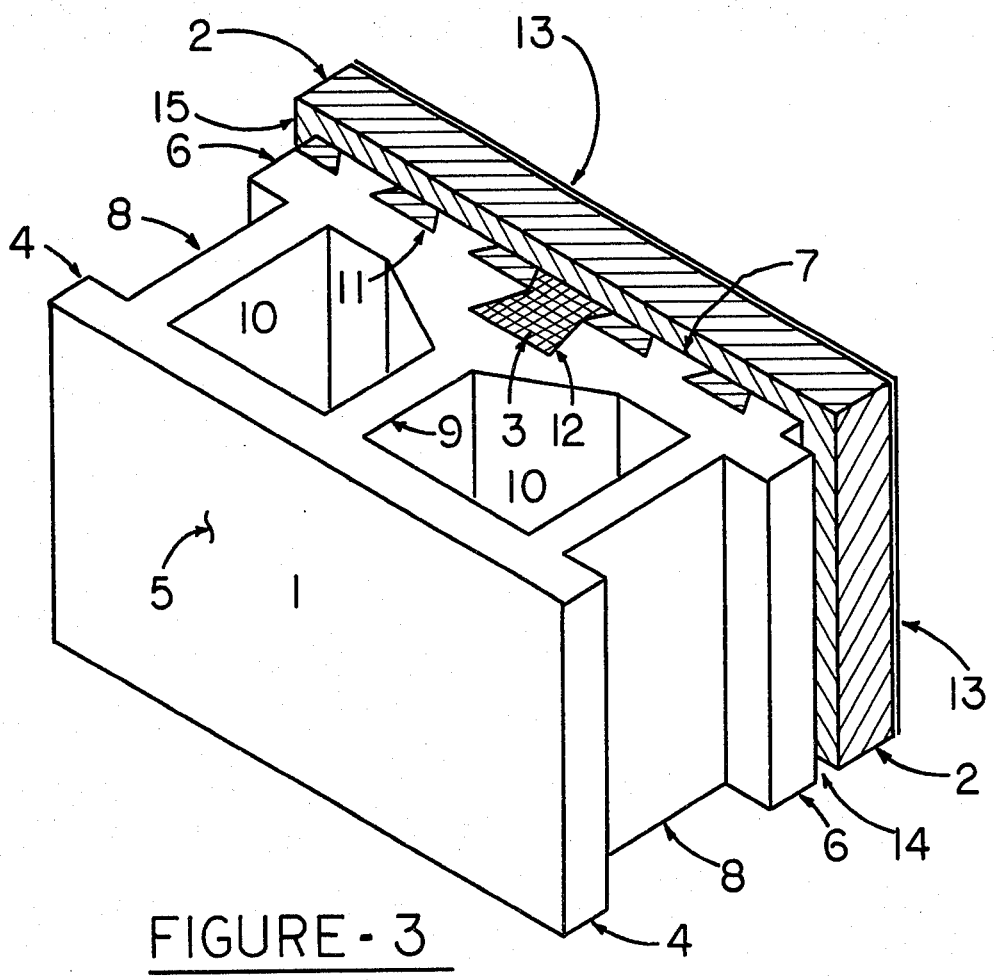
FIG. 3: an isometric view of the block shown in FIG. 1.

Consequently, it is intended that the claims be interpreted to cover such equivalents and subcombinations. This is contemplated by and is within the scope of the invention, as illustrated in FIG. 2. As many possible embodiments may be made of the invention without departing from the scope thereof, it is to be understood that all matter herein set forth or shown in the accompanying drawings is to be interpreted in an illustrative and not in a limiting sense.

The invention having been described, what is claimed is:

1. A basic unit for use in a modular building sytem, said unit comprising:

(a) a masonry element having facing panels joined back to back by perpendicularly extending reinforcing panels, said facing and reinforcing panels forming a square box configuration enclosing void spaces which are open at either end;

(b) an insulation element attached to at least one face panel, said insulation element having greater horizontal and vertical dimensions than the facing panel to which it is attached, whereby the insulation panel will extend beyond the facing panel in both the horizontal and vertical directions to cover joints of the modular building system and to block the movement of moisture into said joints;

(c) a vapor barrier on one surface of the insulation element, and (d) a furring element entrapped between the facing panel and the insulation element, said furring providing a series of attachment zones on at least one face of the modular building system.

2. A basic unit as in claim 1 wherein the furring element is equal in length to the vertical dimension of the facing panel and extends vertically at the horizontal midpoint of the facing panel.

3. A basic unit as in claim 1 wherein the face panel includes a series of dovetail-shaped grooves which receive dovetail-shaped projections on the insulation panels.

4. A basic unit as in claim 3 wherein the furring element has a dovetail-shaped portion which is received in one of the dovetail-shaped grooves.

5. A basic unit as in claim 1 wherein a groove is provided about the perimeter of the facing panel and the juncture between the facing panel and the insulation panels, said groove being designed to trap excess mortar and prevent said excess mortar from being extruded onto edge surfaces of the insulation panels.

* * * * *